United States Patent [19]

Baumgardner

[11] Patent Number: 4,643,302

[45] Date of Patent: Feb. 17, 1987

[54] CONTAINER FOR SPORTS EQUIPMENT

[76] Inventor: Edward W. Baumgardner, 4088 Sells Mill Rd., P.O. Box 1, Taneytown, Md. 21787

[21] Appl. No.: 712,168

[22] Filed: Mar. 15, 1985

[51] Int. Cl.[4] ..... B65D 13/00; A45C 7/00; A63B 55/00

[52] U.S. Cl. ..... 206/315.1; 206/315.3; 206/315.11; 190/22; 190/105; 190/119; 220/8; 292/DIG. 42; 70/73

[58] Field of Search ..... 206/315.1–315.6, 206/315.11; 220/8, 4 B, 4 C; 229/93; 190/103, 104, 108, 22, 105, 119, 120; 292/247, DIG. 42; 70/76, 73; D3/36

[56] References Cited

U.S. PATENT DOCUMENTS

| | | | |
|---|---|---|---|
| D. 257,913 | 1/1981 | O'Dair | D3/36 |
| D. 271,162 | 11/1983 | Evans | D3/36 |
| 1,082,862 | 12/1913 | Geschickter | 150/52 R |
| 1,084,360 | 1/1914 | Rahm | 190/108 |
| 1,406,090 | 2/1922 | Schermuly | 292/247 X |
| 1,414,875 | 5/1922 | Hanaford | 206/315.4 |
| 1,481,223 | 1/1924 | Gorman et al. | 292/247 |
| 1,903,798 | 4/1933 | Turner | 229/93 |
| 2,143,720 | 1/1939 | Smith | 220/8 |
| 2,919,017 | 12/1959 | Weber | 206/315.11 X |
| 2,927,394 | 3/1960 | Johnson | 220/4 B X |
| 3,837,548 | 9/1974 | Nerger | 220/8 X |
| 3,921,871 | 11/1975 | Heil | 220/8 X |
| 3,939,967 | 2/1976 | Tenney et al. | 220/4 B X |
| 4,078,594 | 3/1978 | Oeckl | 206/315.4 |
| 4,350,194 | 9/1982 | Brown | 206/315.5 |

*Primary Examiner*—William Price
*Assistant Examiner*—Sue A. Weaver
*Attorney, Agent, or Firm*—Eugene F. Osborne, Sr.

[57] ABSTRACT

A container is for elongated playing devices and associated game items. It provides protection during storage, handling, and shipping by freight carriers against damage and it offers resistance to theft. Principal parts of the container are made of a plastic material. Its cavity is formed in one or more standardized tubular extrusions to which molded end caps are affixed. Accessories provide for hand and shoulder carrying and lockable hardware secures the cavity. Access to the container cavity is by removal of lockable end caps and in certain embodiments by separation at the unions between two or more tubular sections. The manufacture of the container is adaptable to the requirements of a multiplicity of sports and games.

3 Claims, 18 Drawing Figures

CONTAINER FOR SPORTS EQUIPMENT

This application is related to a copending application, Ser. No. 657,067, filed Oct. 2, 1984, for an ornamental design.

BACKGROUND OF THE INVENTION

1. Field of the Invention

This invention relates to protective containers for storage, handling, and transportation of elongated sporting equipment.

2. Description of Prior Art

For the traveler en route to sporting events, resorts, and recreation centers, the protection and security of valued personal equipment and supplies are long standing problems in those situations where the equipment cannot be carried into the passenger compartment of the transportation vehicle. Elongated sporting equipment is often carried on roof tops of automobiles and in baggage compartments of buses, trains and airplanes. Frequently, while in transit, valuable equipments become separated, are damaged, and are too often forever lost due to theft between time of deposit as baggage and attempted recovery at the point of arrival.

Various clamping devices and tie down straps have been used when transporting elongated sports equipment on automotive rooftops. Shipping bags of canvas, leather, or flexible plastic materials are often used. The ornamental design of a folding container for skis is disclosed in U.S. Pat. No. Des. 257,913. The ornamental design of a cylindrical tubular sports equipment carrier is disclosed in U.S. Pat. No. Des. 271,162.

SUMMARY OF THE INVENTION

The invention is adaptable for use by enthusiasts of several sports that involve elongated playing devices and equipments. Typical examples of elongated playing devices include skis, golf clubs, sails and masts for surfboards and small boats, rowing oars, baseball bats, field hockey and lacrosse sticks, lances, and bows for archery. In a preferred embodiment, the invention is made of a plastic material that is chosen to withstand extreme temperatures without cracking, breaking, or deforming, which is resistant to cutting or puncture by sharp objects, and which is easily workable during manufacture to achieve desired shapes by extrusion and molding processes. With its accessory hardware the plastic container provides protection for valuable sporting equipments placed therein against damage in transit due to weather conditions, abrasion, crushing, or breakage by contact with adjacent packages or items of freight. With its locking features the container provides resistance to tampering and theft of the sporting equipment when left unattended or during shipment as baggage.

The general configuration is tubular with a substantially elliptical cross section that is truncated at opposing extremities of the major axis. Removable end caps are attached to enclose the inner compartment. The assembly includes lockable draw catches for securing the inner compartment, length adjusting plates, fasteners, and a heavy duty adjustable strap for hand or shoulder carrying of the loaded container. Container lengths appropriate for transporting sails and masts for small water craft may use luggage type hand grips for two man handling in lieu of the adjustable strap.

For certain applications the container is formed by intermeshing two or more tubular sections. The sectionalized container is a preferred embodiment for applications where access to the inner compartment is desired at intermediate locations along the length of the container as well as at the end caps. When used with exceptionally long sporting equipment the sectionalized container has an advantage in that it can be broken down, during the sporting event, for storage in spaces having limited dimensions as for example inside an auto or beneath the deck of a small boat.

Thus it is the principal object of this invention to provide a rugged container for the protection and security of elongated sporting equipments while they are in transit to or from events, resorts, and recreation areas.

Another object of the invention is to provide a basic design that is adaptable to the specific requirements of a multiplicity of sports.

Other objects and advantages of the invention will become apparent from the following description of the preferred embodiments.

DESCRIPTION OF THE PREFERRED EMBODIMENTS

Figure 1:
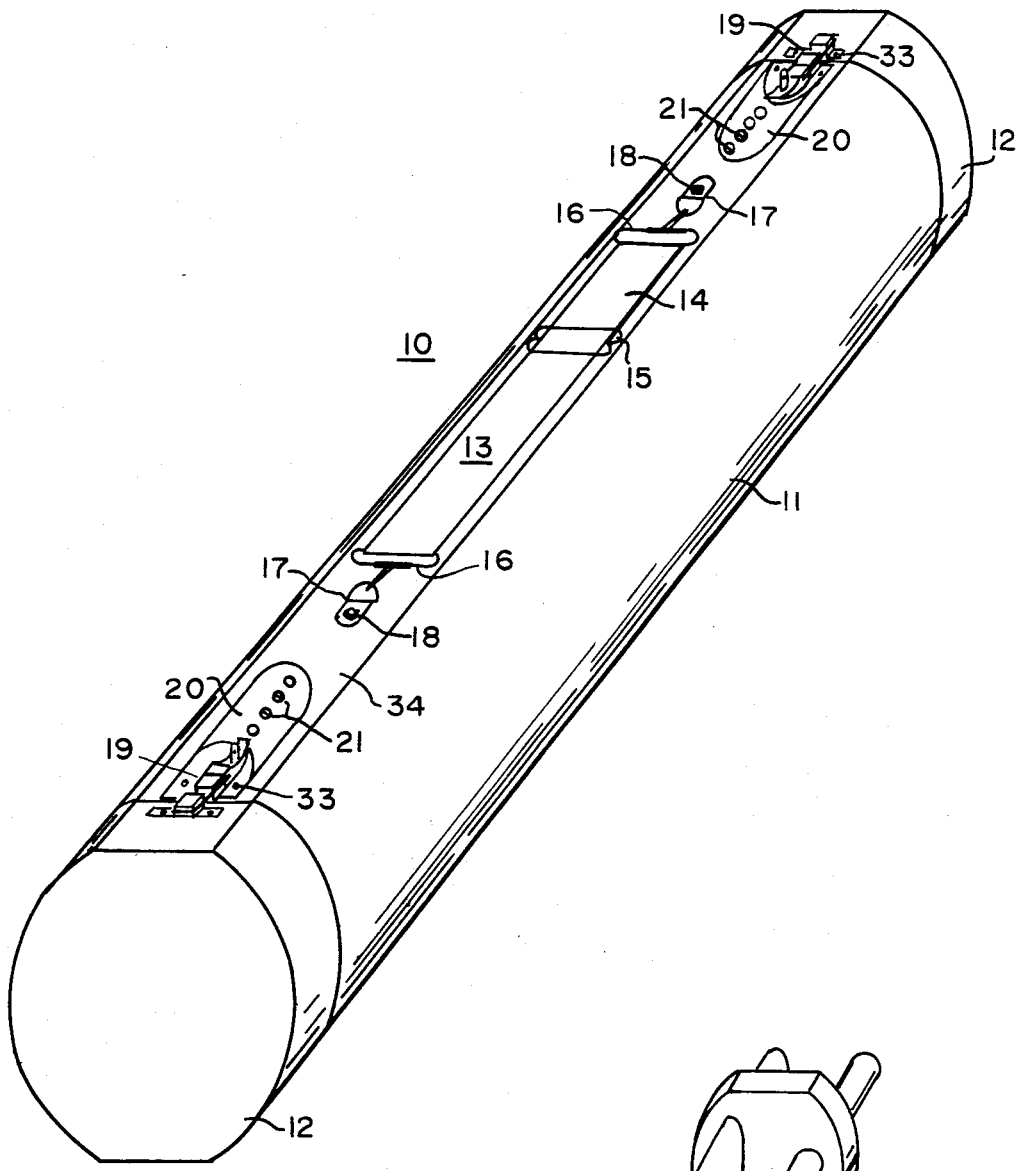
FIG. 1 is a perspective view of a basic container for elongated sporting equipments.
Figure 13:
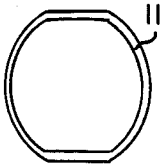
FIG. 13 is a cross section view of the tubular stock.
Figure 16:
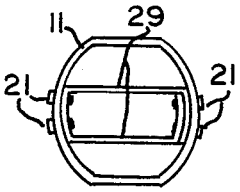
FIG. 16 illustrates a divider for clubs in a golf container.

Referring to FIG. 1 there is illustrated a basic design for a sports equipment container 10 that has an elongated section of an extruded tube 11 each end of which is closed by removable end caps 12 to form a protected inner cavity for sports equipment. The end caps 12 have deep skirts that extend over the outer surface of the tube 11 for a distance sufficient to allow a four inch adjustment of the length of the inner cavity of the container 10. The adjustment feature is useful, for example, in a container designed for carrying different sizes of adult skis. The extruded tube 11 has a cross section, FIGS. 1 and 13, that is substantially elliptical but with truncation, to form flat surfaces 34, near the extremities of the major cross section axis. For convenient personal handling of the loaded container 10, the design includes an adjustable strap 13 for hand or over the shoulder carrying.

Figure 3:
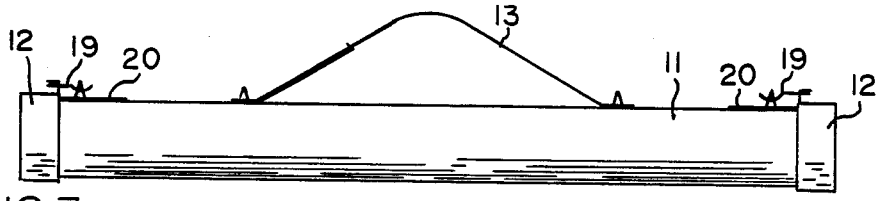
FIG. 3 is a side elevation view of the container of FIG. 1.
Figure 4:
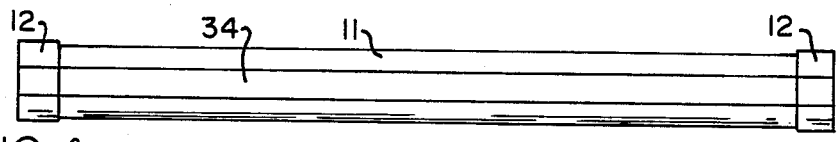
FIG. 4 is a bottom plan view of the container of FIG. 1
Figure 5:
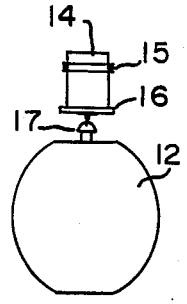
FIG. 5 is an end view showing a strap adjusted for hand carring.
Figure 6:
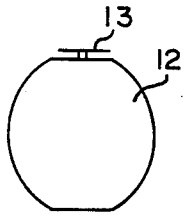
FIG. 6 is an end view showing a strap adjusted for transporting.
Figure 7:
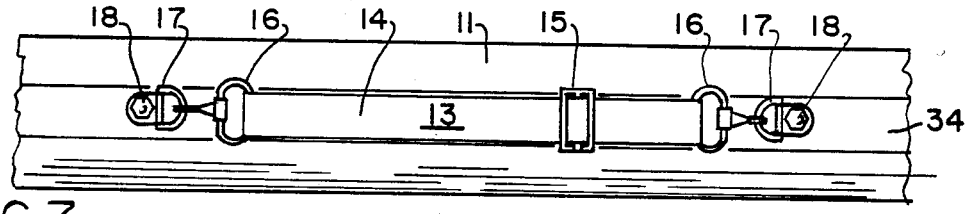
FIG. 7 is a partial top view showing the strap.
Figure 10:
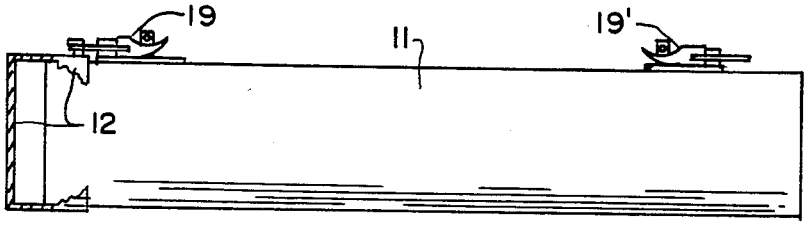
FIG. 10 is a side elevation view of a single tube container with one end cap removed.

Typically, the strap 13 is made of a length of flexible webbing 14, one end being attached to a snap hook 16 and with the webbing 14 extending through the adjustable slide 15 and a second 'floating' snap hook 16 returning for attachment of its second end to the center of the slide 15. For assembly of the strap 13 to the container 10 symmetry in location is desired for stability and balance of the load. For connecting each end of the strap 13, a clip and Dee ring 17 is assembled to the upper flat surface 34 of the tube 11, using a bolt with cap nut 18, FIGS. 1 and 7. The snap hooks 16 are connected to the Dee rings 17. FIGS. 1, 3 and 6 show the strap 13 as adjusted for for shipping and FIGS. 3 and 5 illustrate adjustment of the strap 13 for hand carrying.

Figure 8:
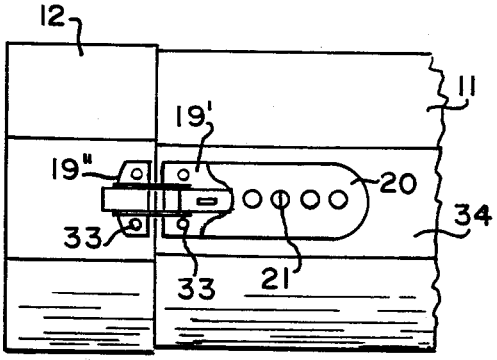
FIG. 8 is a partial top view showing a lockable draw catch and an end cap adjustment plate.
Figure 9:
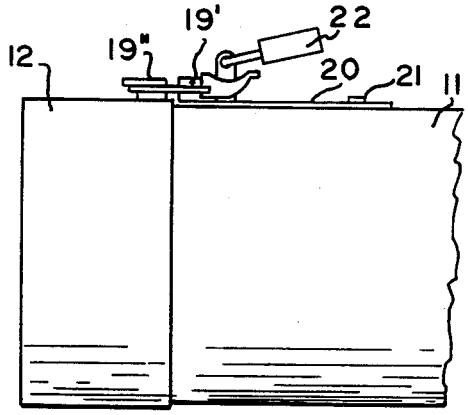
FIG. 9 is a side elevation view of the draw catch.

Draw catches 19 are used to removably secure the end caps 12 to the tubular section 11. Referring to FIGS. 8 and 9 a draw catch consits of two separable portions, a manually operable portion 19' which has a movable extension for fitting over a fixed portion 19'' by which the portions are drawn together. Means are provided for locking the draw catch in its closed position. In the container design 10 the fixed portion 19'' of the draw catch 19 is riveted 33 to the upper flat surface of the end cap 12 and the movable portion 19' is attached, by rivets 33, to an adjustment plate 20. The adjustment plate 20 is in turn attached to the upper flat surface 34 of the extruded tube 11 at one of several locations using at least one stud bolt 21 inserted through combinations of holes in the respective tube 11 and adjustment plate 20.

Figure 11:
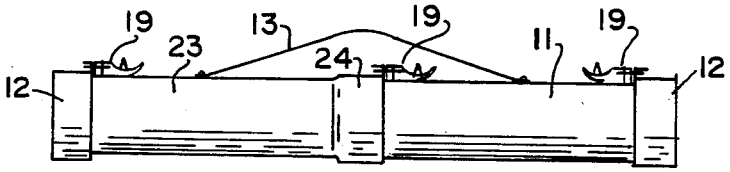
FIG. 11 is a side elevation view showing a twin tube design.

A preferred embodiment of the tubular container for many types of sports equipment involves two or more meshing tubular sections to achieve the total length desired. FIG. 11 illustrates a two section container and FIG. 12, three sections. In the two section container the extruded tube of uniform cross section 11 is inserted into the expanded bell 24 of a second mating extruded tube 23. The opposite ends of the respective tubes, 11 and 23, are contained in end caps 12 as described above with the union of the tubes 11 and 23 and the caps being secured by lockable draw catches 19. In the two section container, FIG. 11, the carrying strap 13 traverses the union of tubes 11 and 23 having one clip and Dee ring 17 fixed at an appropriate location in the upper surface 34 of the respective tubes 11 and 23 for connection thereto.

Figure 12:
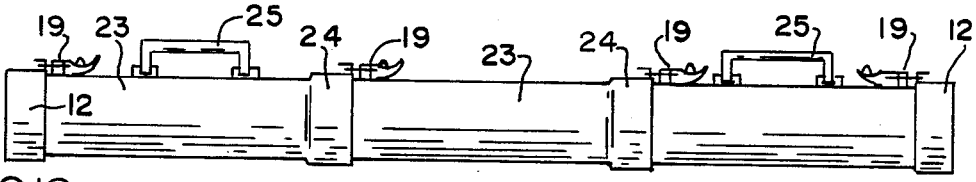
FIG. 12 is a side elevation view showing a triple tube container for extra long sporting equipments.

The three section container, FIG. 12, has similar construction features to those described above except that, in lieu of the carrying strap 13, at least the two outward tubular sections each have luggage type grips 25 for hand carrying by two cooperating persons a greater weight capability of the loaded longer container.

Figure 15:
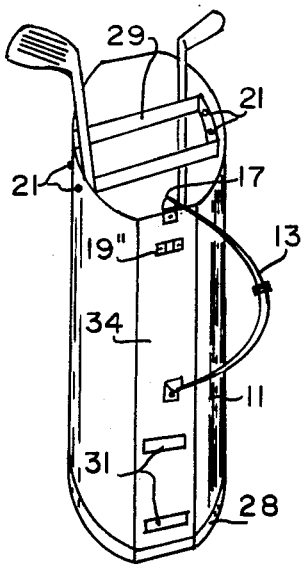
FIG. 15 illustrates a container arranged for golf course play.
Figure 14:
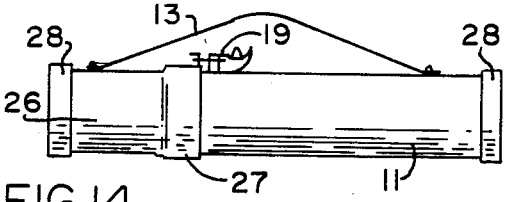
FIG. 14 is a side elevation view of a preferred container for golf equipments.

Illustrations of a special container in a design preferred for golf are shown in FIGS. 14–17. The purpose of the golf container 35 is twofold. First, it provides a protective enclosure for valuable equipment during shipment as baggage, and second, it provides a rugged 'bag' for playing the game on the golf course. Thus, FIG. 14, the long section 11 is of uniform extruded cross section in a length of 32–34 inches and a mating removable section 26 has a shorter length of 16–18 inches, providing total internal cavity dimensions adequate for shipping standard adult clubs. An adhesive is used to permanently affix end caps 28 to the tubular sections 11 and 26. At least one lockable draw catch 19 secures the container 35 as the long section 11 is inserted into the bell 27 of the shorter section 26. The arrangement for course playing is illustrated in FIG. 15 showing tube 11 in an upright position. The carrying strap 13 is extended for shoulder carrying and is connected from an intermediate point in surface 34 of the tubular section 11 to a clip and Dee ring 17 provided at the exposed edge of the tube at point 36. In proximity to the opening of the tube 11 a divider 29 is provided for separating the various golf clubs. The divider 29 is fastened to the wall of the tube 11 by stud bolts 21. The divider 29, also shown in FIG. 16, divides the opening of the tube 11 into three areas. The club divider 29 can be formed from a length of flat narrow material by bending to the desired shape.

Figure 17:
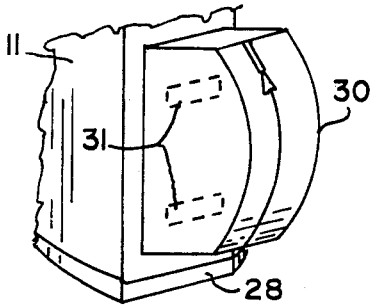
FIG. 17 illustrates an accessory kit bag for external attachment of a golf club container during play.

Adjacent to the permanent end cap 28 of the tube 11, Velcro 31 is applied with an adhesive to cover at least one area of the flat surface 34 of the tube 11 for temporarily bonding an accessory kit bag 30, FIG. 17, to the tube during play on the golf course. Likewise, at least one area of the surface of the kit bag 30 is covered with the mating velcro material 31.

Figure 18:
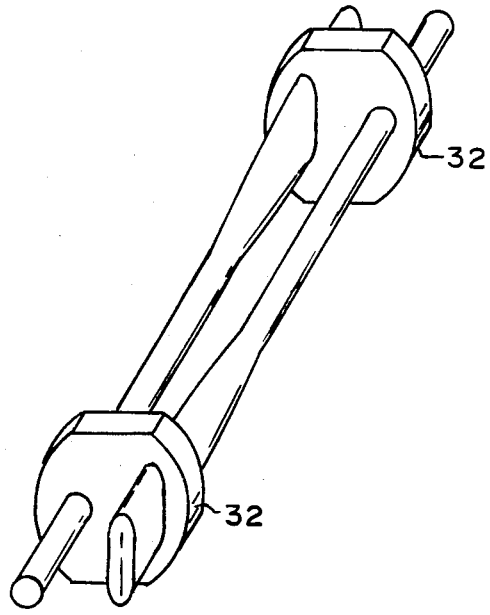
FIG. 18 is a schematic representation of the use of stabilizing inserts for sports equipment while in transit.
Figure 2:
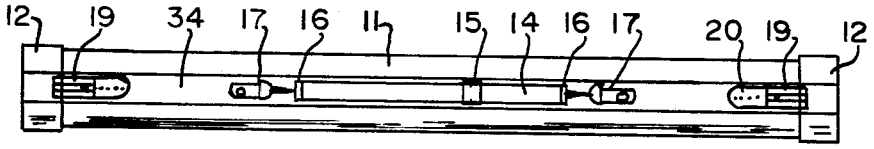
FIG. 2 is a top plan view of the container of FIG. 1.

Highly polished finishes of sports equipments can be protected during transit as baggage by using light weight, soft but rigid inserts 32, made in appropriate shapes to maintain separation of the enclosed parts from styrofoam, for example. FIG. 18 illustrates inserts 32 for a pair of rowing oars.

The sports equipment container can be made from a variety of fabric, leather, metals and plastic materials. However, in the preferred embodiments it is desired that the tubular sections 11, 23, and 26 be formed by extrusion and the end caps 12 and 28 by molding processes. The resultant product must be of low cost and light weight, capable of withstanding wide range in temperature and humidity without cracking, breaking, or deforming under pressure of adjacent items of baggage. It must be semi-rigid yet resistant to puncture or cutting by ordinary hand tools. Thus for the preferred embodiments, the plastic acrylonitrile butadiene styrene, available commercially under the Monsanto label as ABS plastic, is used for the extruded and molded components. The preferred extrusions are in lengths at least as long as 16 inches and the cross section, shown in FIG. 13, measures typically 8.25 inches and 7.5 inches on the major and minor cross section axes. The bells 24 and 27 are formed in selected lengths of the uniformily extruded tubes by controlled heat treatment and expansion of the inner cap mold element within the end of the tubular section.

While only certain preferred embodiments of the invention have been described and illustrated it is understood that variations and modifications are possible without departing from the principles of this invention as defined in the claims.

Having described the invention, I claim:

1. A container assembly for transport and secured storage therein of elongated sports equipments, having means for locking and an adjustable strap for two point suspension of said container during manual handling and carrying, wherein the improvement comprises:

(a) an elongated tube of uniform cross section substantially elliptical in shape but having truncations at opposite extremities of the major elliptical axis thereby forming first and second flat areas that extend along the length of said tube, said first flat area adapted for attachment of said adjustable strap thereto, said second flat area for stabilizing said container when it is placed on supporting surfaces;

(b) a pair of interchangeable and removable end caps having deep skirts for adjustably fitting upon opposing ends of said tube of truncated elliptical cross section for providing means of closure and access to a cavity of adjustable length within said container, each said end cap having at least one stationary portion of a lockable draw catch assembled thereto for securing said container cavity, said draw catch stationary portion located on said major elliptical axis in near proximity to the edge of said end cap skirt;

(c) at least one pair of adjustment plates, each having a manually operable portion of said draw catch mounted thereon, each said adjustment plate having a multiplicity of holes uniformily spaced along the longitudinal axis thereof;

(d) at least two holes, of the size and spacing of said adjustment plate holes, located along the longitudinal center line in said first flat area in near proximity to each end of said tube; and (e) at least one stud bolt for assembly of each adjustment plate and said manually operable portion of said draw catch to said elongated tube at selectable longitudinal locations by insertion of said bolt through matching holes of said plate and said tube so that manual closure of said draw catch positions its respective end cap longitudinally upon said elongated tube for minor adjustment of the length of said container cavity.

2. A container as described in claim 1, wherein the improvement further comprises:

a combination of the length of said end cap skirts and said spacing of said matching holes of said adjustment plate and of said tube whereby a range of adjustment of said cavity length of at least two inches per each said end cap is provided for a total composite range of adjustment of said cavity length of at least four inches.

3. A container as described in claim 1, wherein the improvement further comprises:

(a) said end caps, having said deep skirts, are molded one piece plastic units having an enlarged truncated elliptical cross section for adjustably fitting upon an end of said elongated tube; and (b) said tube is an extruded one piece plastic unit having a range of dimensions of lengths at least as large as 16 inches and cross sections of as large as 7.5 inches for the elliptical minor axis and as large as 8.25 inches for said truncated elliptical major axis.

* * * * *